US011103985B2

(12) United States Patent
Tsai

(10) Patent No.: US 11,103,985 B2
(45) Date of Patent: Aug. 31, 2021

(54) GRIP DEVICE FOR HEXAGONAL WRENCHES

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 268 days.

(21) Appl. No.: 16/459,615

(22) Filed: Jul. 2, 2019

(65) Prior Publication Data

US 2021/0001459 A1 Jan. 7, 2021

(51) Int. Cl.
*B25B 23/16* (2006.01)
*B25B 15/00* (2006.01)
*B25B 23/00* (2006.01)

(52) U.S. Cl.
CPC ..... *B25B 23/16* (2013.01); *B25B 15/008* (2013.01); *B25B 23/0042* (2013.01)

(58) Field of Classification Search
CPC ... B25B 23/16; B25B 15/008; B25B 23/0042; B25B 13/44; B25B 13/10; B25B 13/14; B25B 13/20; B25B 13/34; B25B 13/48; B25B 9/00; B25B 15/00; B25G 1/00; B25G 1/04; B25G 1/08; B25G 1/008; B25G 1/085; B25G 1/105; B25G 3/00; B25G 3/02; B25G 3/12; B25G 3/38
See application file for complete search history.

(56) References Cited

U.S. PATENT DOCUMENTS 2,465,619 A * 3/1949 Veit ..... B25B 13/56 81/177.1
3,113,479 A * 12/1963 Swingle ..... B25G 1/105 81/177.2
6,076,434 A * 6/2000 Boukis ..... B25B 13/14 81/165
6,311,587 B1 * 11/2001 Johnson ..... B25B 13/56 81/177.1
6,332,381 B1 * 12/2001 Vasudeva ..... B25B 15/008 81/177.1
6,791,291 B2 9/2004 Shimizu et al.

* cited by examiner

*Primary Examiner* — Robert J Scruggs

(57) ABSTRACT

A grip device includes a tubular body, an adjustment member, a left slide and a right slide. The body includes a passage, a guiding slot, a recess and a groove. The adjustment member includes threaded portion. The left slide is slidably located in the groove and includes threads which are engaged with the threaded portion of the adjustment member. When the adjustment member is rotated relative to the pin, the threaded portion of the adjustment member drives the threads of the left slide to move the left slide toward the right slide so as to clamp the hexagonal wrench.

8 Claims, 9 Drawing Sheets

GRIP DEVICE FOR HEXAGONAL WRENCHES

BACKGROUND OF THE INVENTION

1. Fields of the Invention

The present invention relates to a grip device, and more particularly, to a grip device which securely accommodates hexagonal wrenches therein and the users can operate the hexagonal wrenches stably.

2. Descriptions of Related Art

The conventional connection compensating device of multi-angular wrench socket is disclosed in U.S. Pat. No. 6,791,291, and comprises a main body which is a cylindrical body. The outer circumference of the main body between two ends thereof is formed with several radially arranged flutes which extend along the circular axis of the main body by a certain length. The flutes have different cross-sectional areas. A connecting section includes a first tubular body fitted around the main body. The first tubular body is rotatable about the circular axis of the main body. The first tubular body is partially overlaid on the flutes. A geometric central axis of the profile of inner circumference of the first tubular body is not coincided with the circular axis of the main body.

There are only five flutes arranged radially along the circular axis of the main body, and flutes have different shapes of cross sections. The wrenches may have English or Metric specifications, so that the device disclosed can only use five different wrenches with the five flutes. If the users want to use more than five wrenches, at least three of the devices have to be prepared. Furthermore, when the wrench is engaged with the flute and the inner circumference of the first tubular body, the wrench may slip off from the flute during rotating, unless the user's finger contacts the lateral side of the hexagonal wrench. This makes the operation of the hexagonal wrenches awkward and inconvenient.

The present invention intends to provide a grip device that eliminates the shortcoming mentioned above.

SUMMARY OF THE INVENTION

The present invention relates to a grip device and comprises a tubular body, an adjustment member, a left slide and a right slide. The body includes a passage, a guiding slot, a recess and a groove. The adjustment member includes threaded portion. The left slide is slidably located in the groove and includes threads which are engaged with the threaded portion of the adjustment member. When the adjustment member is rotated relative to the pin, the threaded portion of the adjustment member drives the threads of the left slide to move the left slide toward the right slide so as to clamp the hexagonal wrench.

The primary object of the present invention is to provide a grip device wherein the distance between the left and right slides are adjustable so as to clamp the hexagonal wrenches of different sizes.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
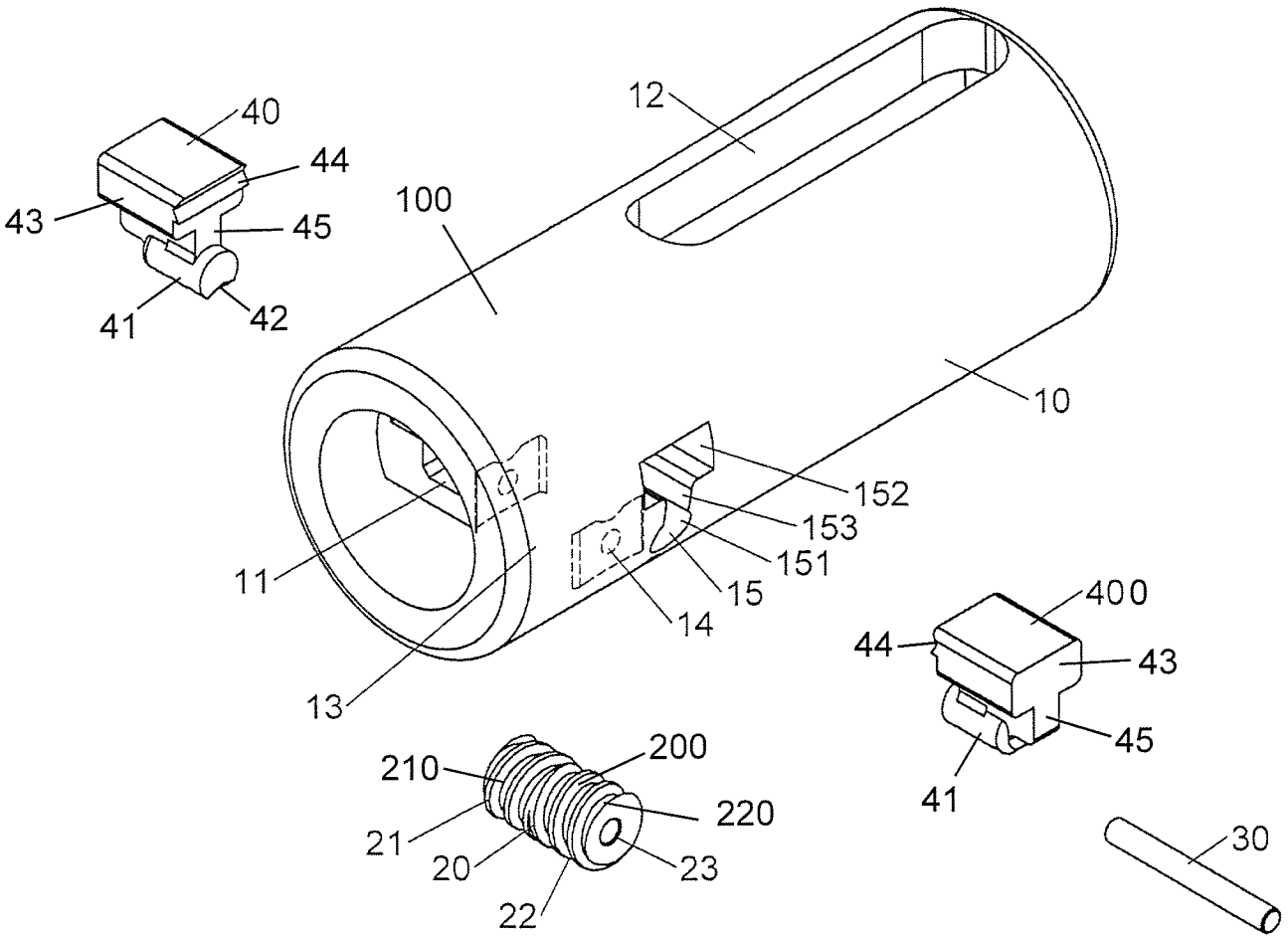
FIG. 1 is an exploded view of the grip device of the present invention.
Figure 4:
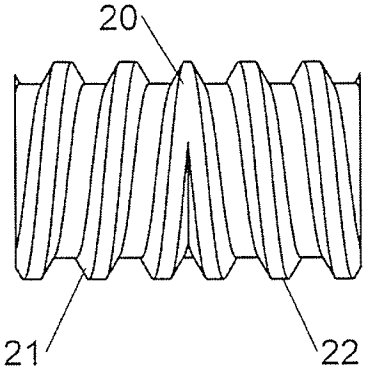
FIG. 4 is a front view of the adjustment member.
Figure 5:
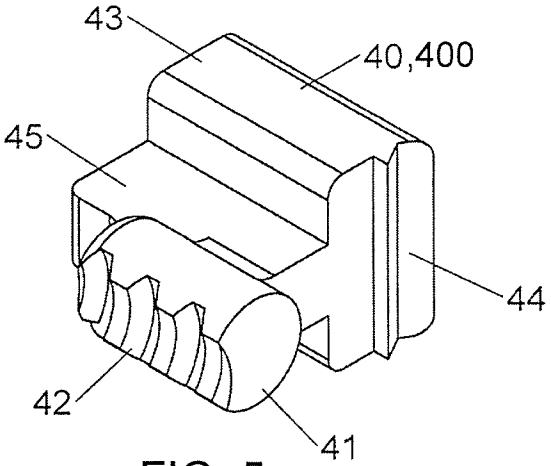
FIG. 5 shows another perspective view of the slides.
Figure 2:
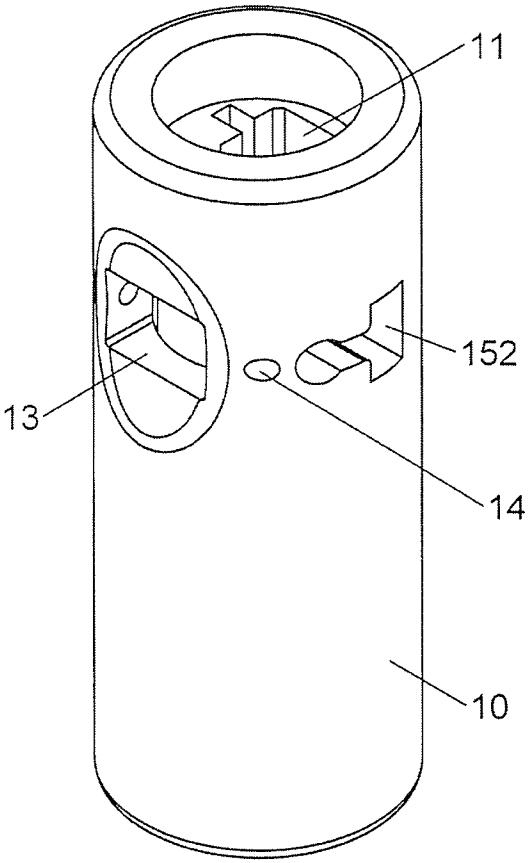
FIG. 2 is a perspective view to show the grip device of the present invention.
Figure 3:
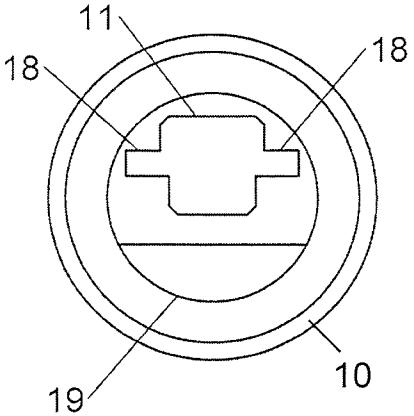
FIG. 3 is a top view of the grip device of the present invention.
Figure 6:
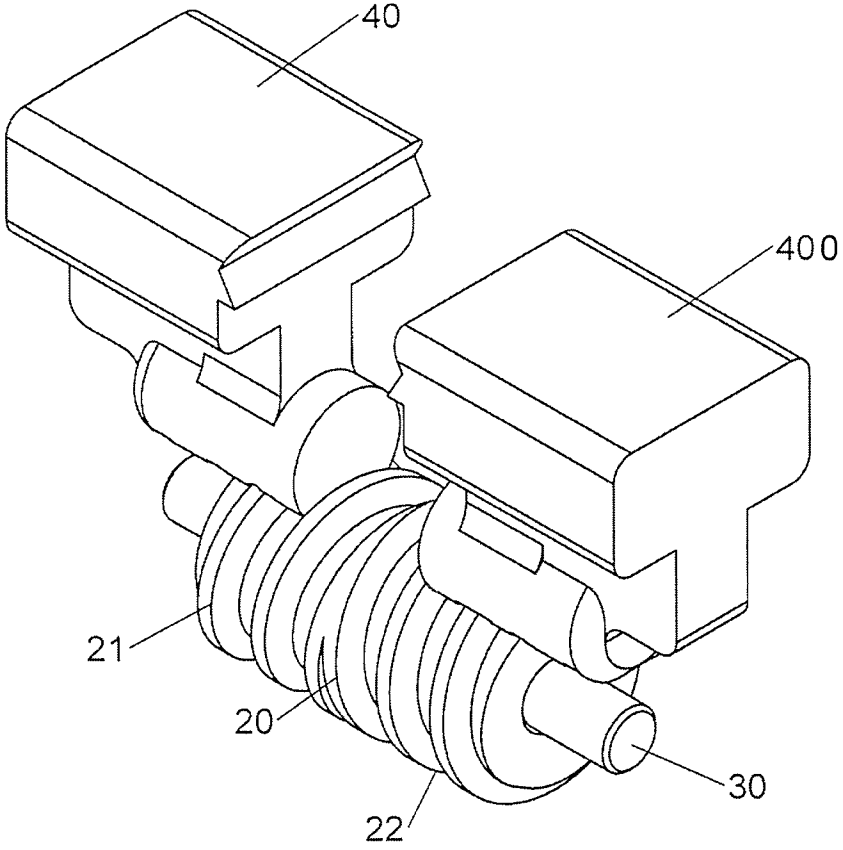
FIG. 6 shows that the left and right slides are engaged with the adjustment member.
Figure 7:
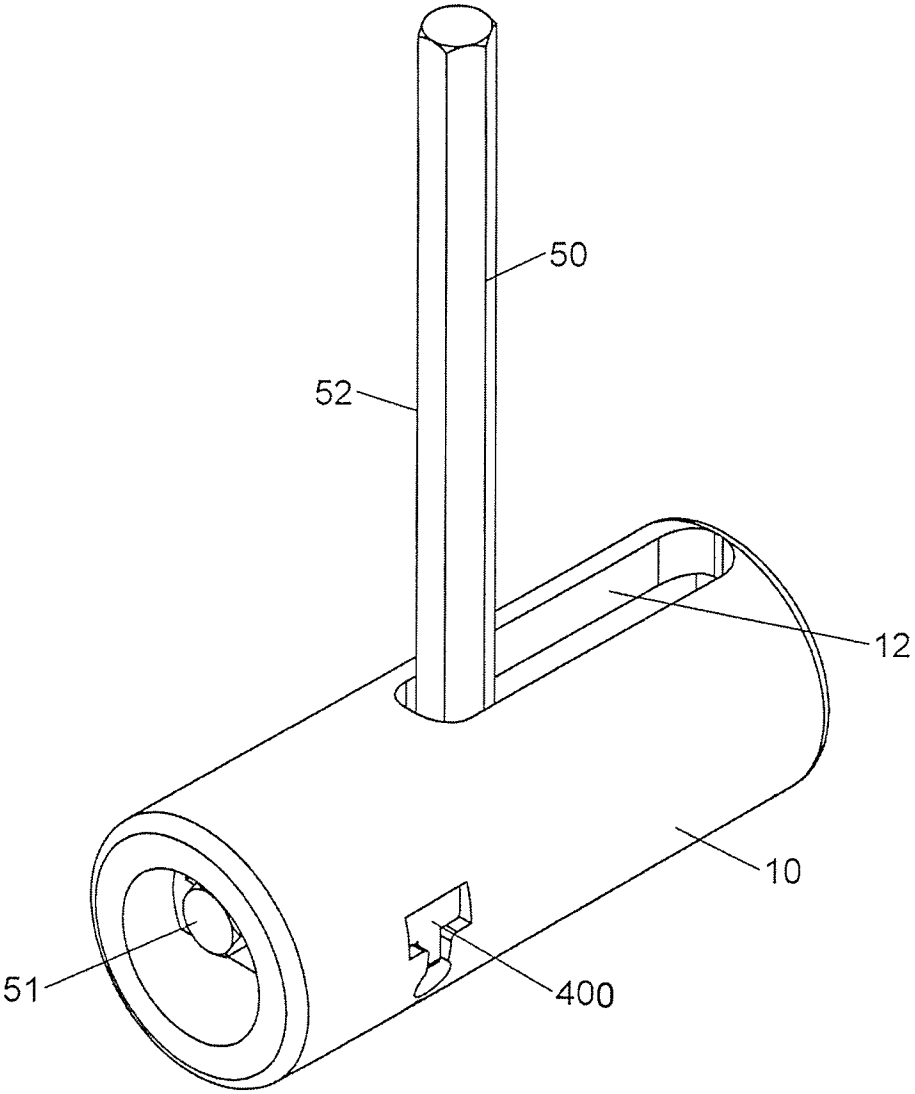
FIG. 7 shows a hexagonal wrench is inserted in the body of the grip device of the present invention.
Figure 8:
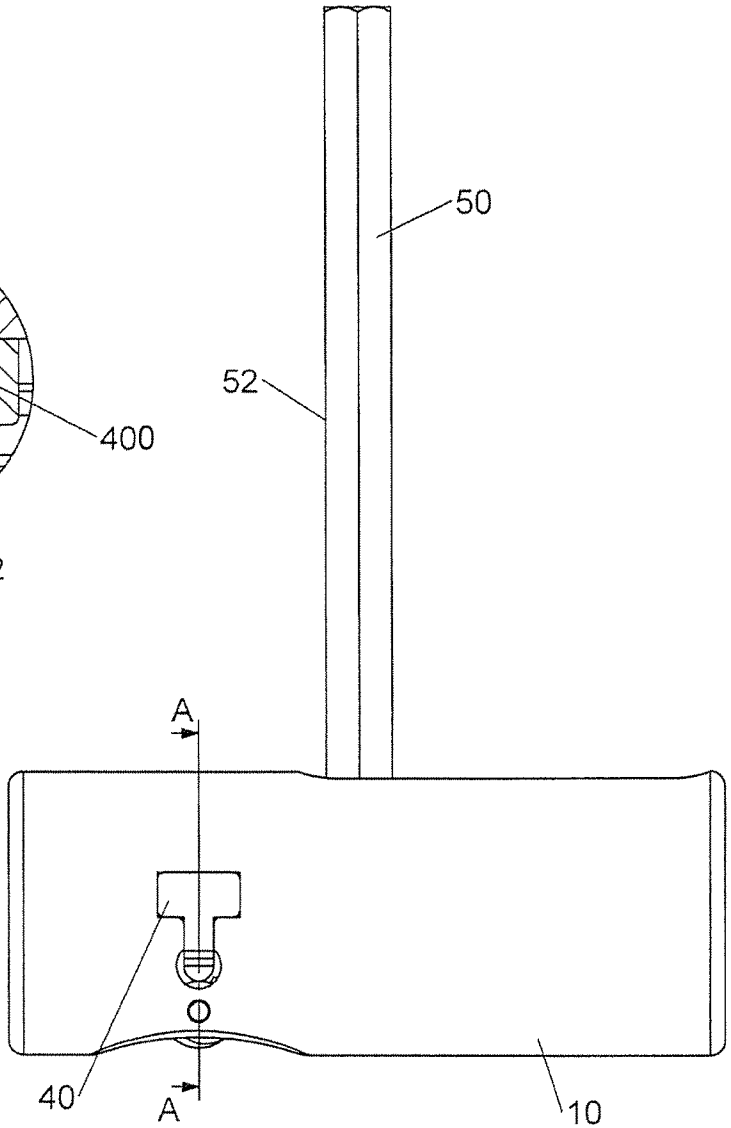
FIG. 8 is a side view of the disclosure in FIG. 7.
Figure 9:
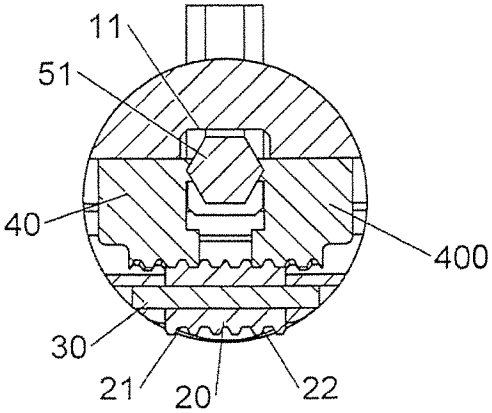
FIG. 9 is a cross sectional view, taken along line A-A of FIG. 8.
Figure 10:
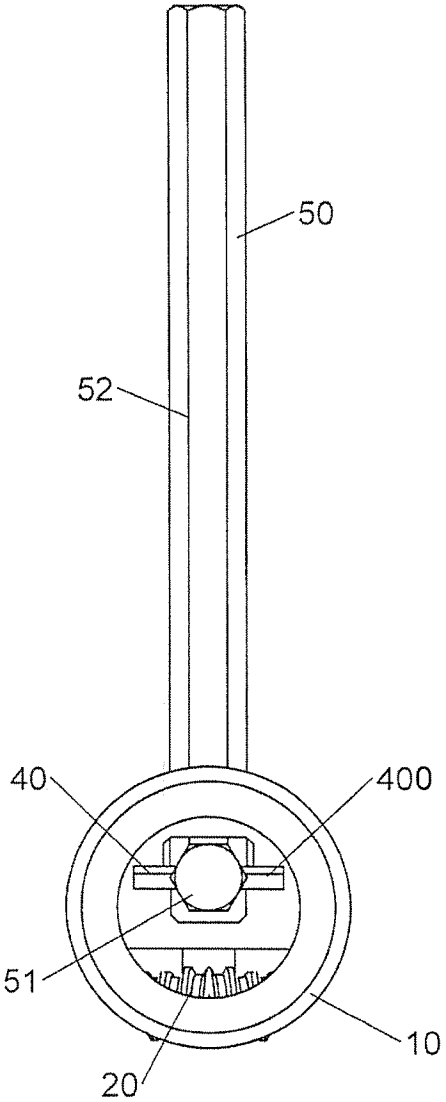
FIG. 10 is a front view of the disclosure in FIG. 7.

Referring to FIGS. 1 to 6, the grip device of the present invention comprises a round and tubular body 10 which includes having a rectangular passage 11 defined axially therethrough. The body 10 includes a front section and a rear section 100, wherein a guiding slot 12 and a recess 13 are respectively and diametrically defined in opposite through the wall of the body 10. The guiding slot 12 is located in the front section and the recess 13 is located in the rear section 100. A groove 15 is radially defined radially through the body 10 and located in the rear section 100. The groove 15 communicates with the passage 11 and the recess 13, and the guiding slot 12 and the recess 13 respectively communicate with the passage 11. A hole 14 is defined through two inside walls of the recess 13. The groove 15 includes a bottom groove 151, a top groove 152 and a middle groove 153. The bottom groove 151, the top groove 152 and the middle groove 153 have different shapes. The bottom groove 151 is a round cylindrical groove 151, the top groove 152 is a rectangular groove, and the middle groove 153 is a rectangular groove. The bottom groove 151 communicates with the recess 13, and the middle groove 153 communicates with the passage 11. The width of the middle groove 153 is smaller than the width of the top groove 152, and the width of the middle groove 153 is smaller than the diameter of the bottom groove 151. Each of two inside walls of the passage 11 has a notch 18 defined therein, and the two notches 18 are perpendicular to the axis of the passage 11. The notches 18 each are a rectangular notch which extends along the passage 11, and the length of each notch 18 is the same as the length of the passage 11. A first section 51 of a hexagonal wrench 50 can be accommodated in the passage 11. The top groove 152 communicates with the notches 18. The body 10 includes a half-moon-shaped chamber 19 which is parallel with the passage 11 and does not communicate with the passage 11. The passage 11 is located between the slit 12 and the chamber 19.

An adjustment member 20 has a threaded portion 200 formed on the outer periphery thereof. An axial hole 23 is defined axially through the adjustment member 20. A pin 30 extends through the hole 14 of body 10 and the axial hole 23 of the adjustment member 20. The adjustment member 20 is located in the recess 13. The threaded portion 200 of the adjustment member 20 includes left threads 21 and right threads 22, wherein the left threads 21 and the right threads 22 are opposite in threading direction.

A left slide 40 and a right slide 400 respectively and slidably located in the groove 15 of the body 10. The left slide 40 including a bottom portion 41, a top portion 43 and a middle portion 45. The bottom portion 41, the top portion 43 and the middle portion 45 are respectively shaped and slidable in the bottom groove 151, the top groove 152 and the middle groove 153 of the groove 15 of the body 10. Specifically, the bottom portion 41 is a round cylindrical portion so as to be slidable in the bottom groove 151, the top portion 43 is a rectangular portion so as to be slidable in the top groove 152, and the middle portion 45 is rectangular portion so as to be slidable in the middle groove 153. The bottom portion 41 includes threads 42 which are engaged with the threaded portion 200 of the adjustment member 20. Each of the left and right slides 40, 400 has a V-shaped clamping portion 44. In this embodiment, the right slide 400 is identical with the left slide 40. The left slide 40 and the right slide 400 are respectively inserted into the groove 15 from two openings formed in the body 10 by the groove 15. The left and right slides 40, 400 are symmetrical relative to the passage 11, and are respectively engaged with the two respective threads 42 of the left slide 40 and the right slide 400.

Figure 11:
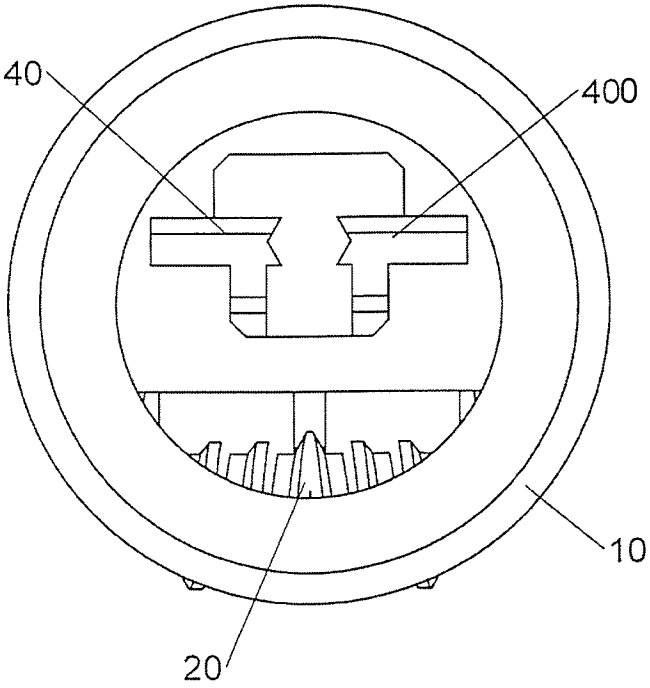
FIG. 11 is an enlarged front view two show the two clamping portions of the left and right slides.
Figure 12:
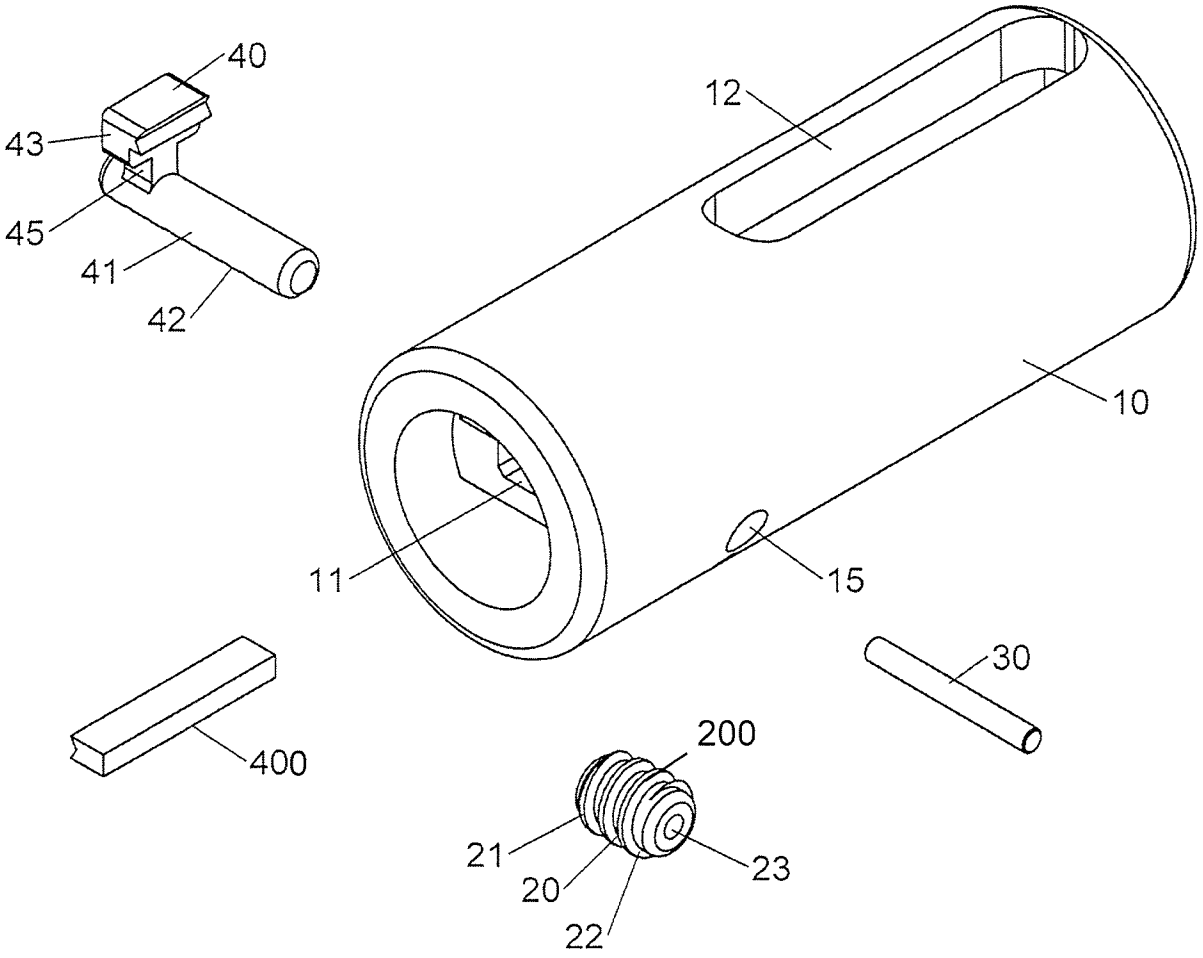
FIG. 12 is an exploded view of the second embodiment of the grip device of the present invention.
Figure 14:
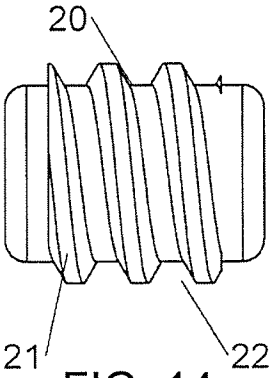
FIG. 14 is a front view of the adjustment member of the second embodiment of the grip device of the present invention.
Figure 15:
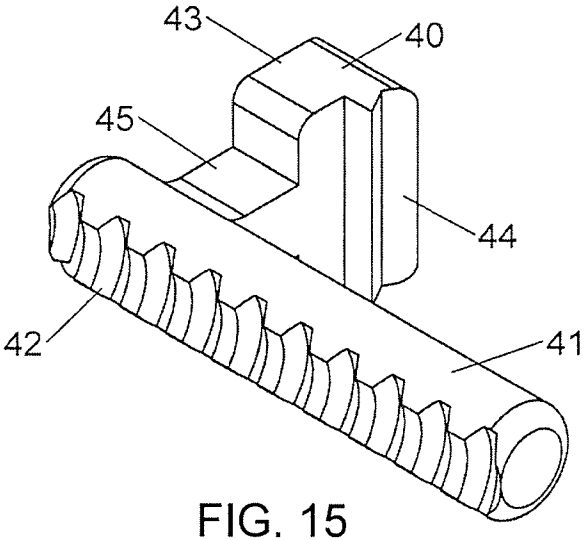
FIG. 15 shows another perspective view of the slides of the second embodiment of the grip device of the present invention.
Figure 13:
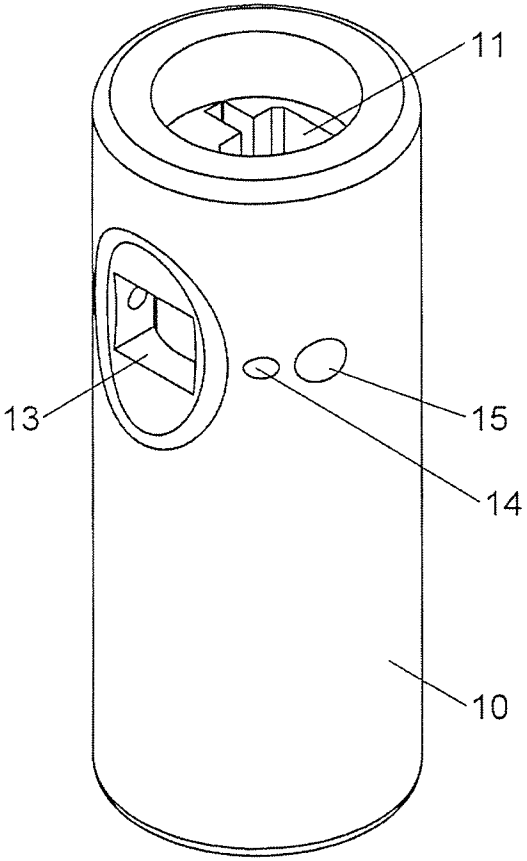
FIG. 13 is a perspective view to show the second embodiment of the grip device of the present invention.
Figure 16:
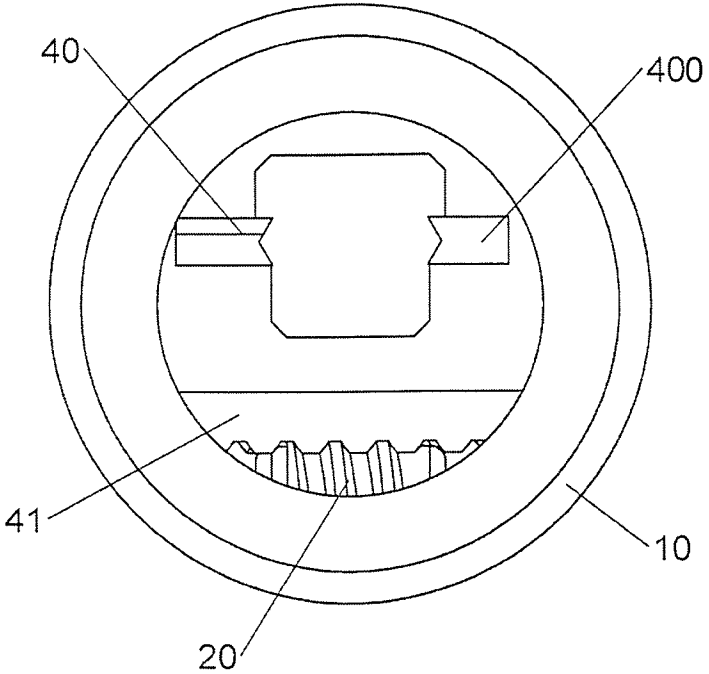
FIG. 16 is a front view of the second embodiment of the grip device of the present invention.

When the adjustment member 20 is rotated relative to the pin 30, the left threads 21 and the right threads 22 of the adjustment member 20 drive the left slide 40 and the right slide 400 to move toward the passage 11 so as to adjust the distance between the two clamping portions 44 of the left slide 40 and the right slide 400. Therefore, the two clamping portions 44 of the left and right slides 40, 400 clamp two ridges of the first section 51 of the hexagonal wrench 50 of different sizes as shown in FIG. 11.

As shown in FIGS. 7 to 10, the hexagonal wrench 50 is an L-shaped wrench and includes a first section 51 and a second section 52. The first section 51 includes a hexagonal cross section, and the first section 51 is shorter than the second section 52. The first section 51 is inserted into the passage 11 from the guiding slot 12 and slides to the groove 15. When the adjustment member 20 is rotated relative to the pin 30, the left slide 40 moves toward the right slide 400, the two clamping portions 44 of the left and right slides 40, 400 clamp two ridges of the first section 51 of the hexagonal wrench 50. The hexagonal wrench 50 is then restricted by the left and right slides 40, 400 and cannot disengage from the body 10.

As shown in FIGS. 12 to 16, the second embodiment of the present invention is disclosed, wherein the bottom groove 151 of the groove 15 form two openings in the rear section 100 of the body 10. The left slide 40 and the right slide 400 have different shapes. The right slide 400 is a rectangular stick with the V-shaped clamping portion. The left slide 40 is similar to that of the first embodiment, while the cylindrical bottom portion 41 is longer than that of the first embodiment. The right slide 400 is secured in the passage 11. When the adjustment member 20 is rotated relative to the pin 30, the left threads 21 of the adjustment member 20 are engaged with threads 42 of the left slide 40 and the left slide 40 moves toward the right slide 400. The two clamping portions 44 of the left and right slides 40, 400 clamp two ridges of the first section 51 of the hexagonal wrench 50.

The advantages of the present invention are that when the adjustment member 20 is rotated relative to the pin 30, the left slide 40 moves toward the right slide 400, so that the two clamping portions 44 of the left and right slides 40, 400 clamp two ridges of the first section 51 of the hexagonal wrench 50 of different sizes.

The hexagonal wrenches 50 may have Metric or English systems, and the two clamping portions 44 of the left and right slides 40, 400 clamp two ridges of the first section 51 of the hexagonal wrench 50 regardless of the system that the wrench 51 may have. When the two clamping portions 44 of the left and right slides 40, 400 clamp two ridges of the first section 51 of the hexagonal wrench 50, the hexagonal wrench 50 is then restricted by the left and right slides 40, 400 and cannot disengage from the body 10.

While we have shown and described the embodiment in accordance with the present invention, it should be clear to those skilled in the art that further embodiments may be made without departing from the scope of the present invention.

What is claimed is:

1. A grip device comprising:

a tubular body having a passage defined axially therethrough, the passage being a rectangular passage, the body including a front section and a rear section, a guiding slot and a recess respectively and diametrically defined in opposite through a wall of the body, the guiding slot located in the front section and the recess located in the rear section, a groove defined radially through the body and located in the rear section, the groove communicating with the passage and the recess, the guiding slot and the recess respectively communicating with the passage, a hole defined through two inside walls of the recess, the groove including a bottom groove, a top groove and a middle groove, the bottom groove, the top groove and the middle groove having different shapes, the bottom groove communicating with the recess, the middle groove communicating with the passage, a width of the middle groove being smaller than a width of the top groove, the width of the middle groove being smaller than a diameter of the bottom groove, each of two inside walls of the passage having a notch defined therein, the two notches being perpendicular to an axis of the passage, a first section of a hexagonal wrench being accommodated in the passage, the top groove communicating with the notches;

an adjustment member having a threaded portion formed on an outer periphery thereof, an axial hole defined axially through the adjustment member, a pin extending through the hole of body and the axial hole of the adjustment member, the adjustment member located in the recess, and a left slide and a right slide respectively and slidably located in the groove of the body, the left slide including a bottom portion, a top portion and a middle portion, the bottom portion, the top portion and the middle portion respectively shaped and slidable in the bottom groove, the top groove and the middle groove of the groove of the body, the bottom portion including threads which are engaged with the threaded portion of the adjustment member, each of the left and right slides having a V-shaped clamping portion, when the adjustment member is rotated relative to the pin, the threads of the bottom portion of the left slide engaged with the threaded portion of the adjustment member so that the left slide moves toward the right slide, the two clamping portions of the left and right slides clamp two ridges of the first section of the hexagonal wrench.

2. The grip device as claimed in claim 1, wherein the body is a round and cylindrical body.

3. The grip device as claimed in claim 1, wherein the right slide is identical with the left slide, the left slide and the right slide respectively inserted into the groove from two openings formed in the body by the groove, the left and right slides are symmetrical relative to the passage, the threaded portion of the adjustment member includes left threads and right threads, the left threads and the right threads are opposite in threading direction and are respectively engaged with the two respective threads of the left slide and the right slide, when the adjustment member rotates relative to the pin, the left threads and the right threads of the adjustment member drive the left slide and the right slide to move toward the passage so as to adjust a distance between the two clamping portions of the left slide and the right slide.

4. The grip device as claimed in claim 1, wherein the bottom groove is a round cylindrical groove, the top groove is a rectangular groove, the middle groove is a rectangular groove, the bottom portion is a round cylindrical portion so as to be slidable in the bottom groove, the top portion is a rectangular portion so as to be slidable in the top groove, the middle portion is rectangular portion so as to be slidable in the middle groove.

5. The grip device as claimed in claim 1, wherein the notches each are a rectangular notch which extends along the passage, a length of each notch is the same as a length of the passage.

6. The grip device as claimed in claim 1, wherein the body includes a chamber which is parallel with the passage and does not communicate with the passage, the passage is located between the slit and the chamber.

7. The grip device as claimed in claim 1, wherein the hexagonal wrench is an L-shaped wrench and includes a first section and a second section, the first section includes a hexagonal cross section, the first section is shorter than the second section, the first section is inserted into the passage from the guiding slot and slides to the groove, when the adjustment member is rotated relative to the pin, the left slide moves toward the right slide, the two clamping portions of the left and right slides clamp two ridges of the first section of the hexagonal wrench.

8. The grip device as claimed in claim 1, wherein the bottom groove of the groove form two openings in the rear section of the body, the left slide and the right slide have different shapes, the right slide is secured in the passage, when the adjustment member is rotated relative to the pin, the left threads of the adjustment member are engaged with threads of the left slide and the left slide moves toward the right slide, the two clamping portions of the left and right slides clamp two ridges of the first section of the hexagonal wrench.

* * * * *